US009770833B2

(12) United States Patent
Schekalla et al.

(10) Patent No.: US 9,770,833 B2
(45) Date of Patent: Sep. 26, 2017

(54) KNIFE

(71) Applicant: MARTOR KG, Solingen (DE)

(72) Inventors: Peter Schekalla, Wuppertal (DE); Martin Herlitz, Remscheid (DE); Martin Rohrbach, Horn (DE)

(73) Assignee: MARTOR KG, Solingen (DE)

( * ) Notice: Subject to any disclaimer, the term of this patent is extended or adjusted under 35 U.S.C. 154(b) by 0 days.

(21) Appl. No.: 14/423,603

(22) PCT Filed: Oct. 2, 2013

(86) PCT No.: PCT/DE2013/000558
§ 371 (c)(1),
(2) Date: Feb. 24, 2015

(87) PCT Pub. No.: WO2014/053113
PCT Pub. Date: Apr. 10, 2014

(65) Prior Publication Data

US 2015/0328782 A1 Nov. 19, 2015

(30) Foreign Application Priority Data

Oct. 2, 2012 (DE) ..... 10 2012 019 107
Sep. 30, 2013 (EP) ..... 13004720

(51) Int. Cl.
*B26B 5/00* (2006.01)
*B26B 1/08* (2006.01)

(52) U.S. Cl.
CPC ..... *B26B 5/00* (2013.01); *B26B 1/08* (2013.01); *B26B 5/001* (2013.01); *B26B 5/003* (2013.01)

(58) Field of Classification Search
CPC .... B26B 1/00; B26B 1/08; B26B 5/00; B26B 5/001; B26B 5/003
See application file for complete search history.

(56) References Cited

U.S. PATENT DOCUMENTS 2,662,284 A * 12/1953 Unsinger ..... B26B 1/08 30/162
4,899,443 A 2/1990 Beermann
(Continued)

FOREIGN PATENT DOCUMENTS

DE 19925123 A1 * 12/2000 ..... B26B 5/00
DE 102010019571 * 11/2011
(Continued)

*Primary Examiner* — Jennifer Swinney
(74) *Attorney, Agent, or Firm* — Andrew Wilford

(57) ABSTRACT

The invention relates to a knife including a housing (11) inside which a blade holder (15) is movably mounted. The blade holder (15) comprises a main part (17) and least one holding part (18) which is movable between a holding position and a in replacement position. In the holding position, a blade (16) can be tightly retained in a replaceable manner in a blade seat between a first holding surface (46) of the main part (17) and a second holding surface (45) of the holding part (18), while in the replacement position, the blade (16) can be removed from the blade seat or a new blade can be mounted in the blade seat. The invention is characterized in that in at least one relative position of the blade holder (15) to the housing (11), the blade holder (15) is biased against a stop (21) by a restoring force, and in that the holding part (18) can be moved into the blade replacement position by having an abutment surface (24) on the stop (21) cooperate with a mating surface (25) on the blade holder (15).

5 Claims, 9 Drawing Sheets

(56) References Cited

U.S. PATENT DOCUMENTS

| | | | | |
|---|---|---|---|---|
| 7,647,702 | B2 | 1/2010 | Polei | |
| 7,784,189 | B2 | 8/2010 | Polei | |
| 8,468,702 | B2 | 6/2013 | Doeren | |
| 2007/0256310 | A1* | 11/2007 | Pool | B26B 5/00 30/339 |
| 2011/0005087 | A1* | 1/2011 | Doeren | B26B 5/001 30/330 |

FOREIGN PATENT DOCUMENTS

| | | | | |
|---|---|---|---|---|
| DE | 202010006500 | U | 11/2011 | |
| DE | EP 2719507 | A2 * | 4/2014 | B26B 1/08 |

* cited by examiner

KNIFE

CROSS REFERENCE TO RELATED APPLICATIONS

This application is the US-national stage of PCT application PCT/DE2013/000558 filed 2 Oct. 2013 and claiming the priority of German patent application 102012019107.3 itself filed 2 Oct. 2012 and European patent application 13004720.2 itself filed 30 Sep. 2013.

FIELD OF THE INVENTION

The invention relates to a knife.

BACKGROUND OF THE INVENTION

Such a knife is known from public prior use. It has a housing with a blade holder in which a knife blade is held. The blade holder has a main part and a holding part. The blade is held between a surface of the main part and a surface of the holding part in a blade seat. The holding part is movable between a holding position and a blade replacement position. In the blade holding position the blade is held tightly in the blade seat between the holding part and the main part. In the blade replacement position the holding part is spaced or pivoted away at least partially from the main part, so that the blade can be removed from the blade seat and a new blade can be inserted into the blade seat.

The housing has two housing parts. A housing body is movable relative to a housing insert between a closed position and an open position. The housing body is part of an actuating system. The holding part is moved from the blade holding position into the blade replacement position by movement of the housing body from the closed position into the open position.

OBJECT OF THE INVENTION

An object of the invention is to create a knife in which the holding part is moved automatically into the blade replacement position when the housing is opened. Furthermore an object of the invention was to create a knife of simple construction and can be produced cost effectively.

SUMMARY OF THE INVENTION

This object is attained by a knife having a housing in which a blade holder is movably mounted, i.e. the blade holder is movable relative to the housing. The blade holder is for example always in a cutting position in which the blade at least partially projects out of the housing. According to an alternative embodiment the blade holder is movable at least between the cutting position and a home position. In the home position the blade held in the blade holder is retracted back into the housing so that there is no danger of injury to the user of the knife.

The blade holder has a main part and at least one holding part. The holding part is movable between a holding position and a replacement position. The blade is tightly held in the holding position between a first contact surface of the main part and a second contact surface of the holding part. The first contact surface and the second contact surface form a blade seat. In the replacement position the blade can be removed from the blade seat and then for example a new blade can be fitted into the blade seat.

In at least one position relative to the housing the blade holder is biased against a stop by a restoring force, in particular by the spring force of a spring element. Within the context of the invention, this means that in all positions relative to the housing the blade holder is biased against the stop for example by a restoring force. The blade holder is for example biased by the spring force into the home position and against the stop. According to one embodiment for example the blade holder is always in contact with the stop. According to an alternative embodiment, in at least one position the blade holder is in contact with the stop and in at least one position it is not in contact with the stop.

The holding part is biased into the blade replacement position under the effect of the spring force by the interaction of an abutment surface of the stop with a mating surface of the blade holder. The holding part can move into the blade replacement position due to the spring force, for example when its travel path is free. The stop acts for example with the blade holder, in particular with the holding part, as a motion transducer.

According to one embodiment the stop cooperates with the holding part of the blade holder. In this case the mating surface is formed on the holding part.

According to a further embodiment of the invention the holding part is pivotal on the main part. The holding part is for example pivotal on the main part between the holding position and the replacement position.

In a further embodiment of the invention the holding part is formed as a lever with at least two arms. In this case the holding part has at least a first lever arm and a second lever arm.

The lever is for example pivotable about an axis formed by the main part.

The first contact surface is formed for example on the first lever arm and the mating surface is formed on the second lever arm.

According to an embodiment the abutment surface forms an angle with respect to a direction of action of the force of the spring, so that the spring force is redirected. Within the context of the invention this means for example that a plane of the abutment surface is at an angle to the direction of action of the force the spring. In this way a force is exerted on the mating surface by the abutment surface. The force biases the holding part for example into the replacement position.

A further embodiment of the invention provides that the housing has a housing body and at least one housing insert, wherein the housing insert is movable relative to the housing body between an open position and a closed position.

A further embodiment is characterized in that in the open position the housing insert is out of the travel path of the holding part in such a way that the holding part is movable into the replacement position and that in the closed position the housing insert prevents movement of the holding part into the replacement position. In the closed position the housing insert is for example in the travel path of the holding part, so that movement into the replacement position is not possible.

On movement from the open position into the closed position for example, the housing insert cooperates with the holding part in such a way that the holding part is moved into the holding position. For example, the housing insert presses on the first lever arm of the blade holder and moves this lever arm into the replacement position. The holding part can also be movably connected in another way to the housing insert, so that it is moved into the holding position when the housing insert is moved into the closed position.

According to one embodiment of the invention the blade holder is movable between a home position and a cutting position, the blade holder being biased against the stop at least in the home position. The blade holder can also for example be biased against the stop when it is moved away from the cutting position beyond the home position.

BRIEF DESCRIPTION OF THE DRAWING

Further advantages of the invention are apparent from reference to an embodiment shown in the drawings, in which.

SPECIFIC DESCRIPTION OF THE INVENTION

Figure 1:
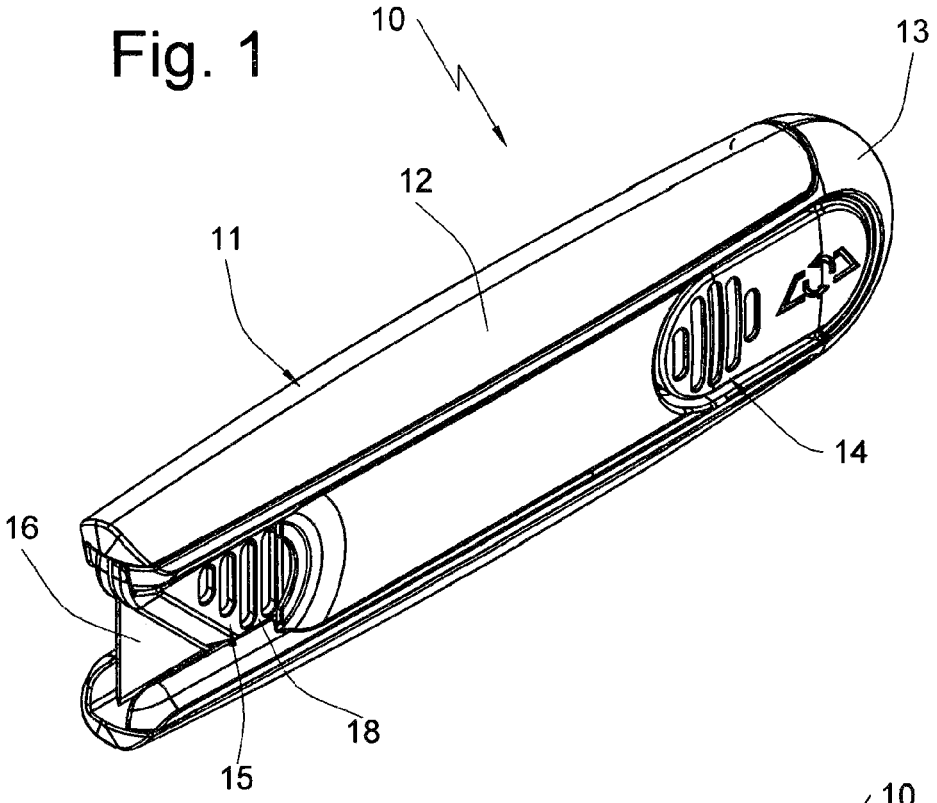
FIG. 1 is a schematic perspective view of the knife where a housing insert is in the closed position.
Figure 2:
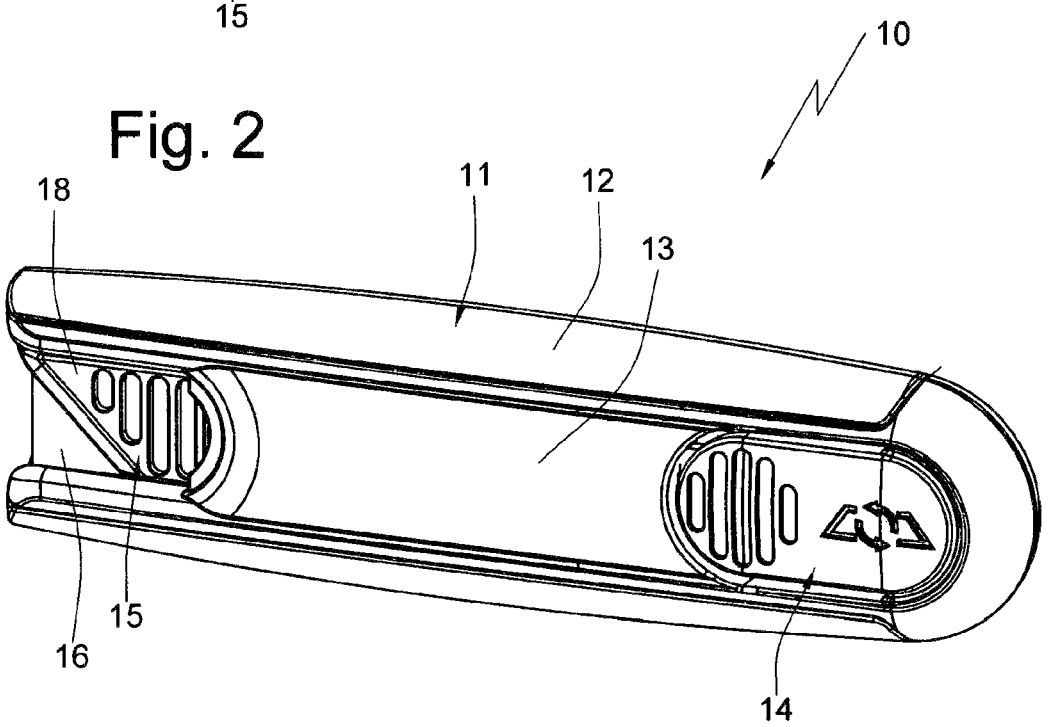
FIG. 2 is a schematic perspective back view of the knife according to FIG. 1.

In the drawings the knife according to the invention is designated generally at 10. In the different drawings the same reference numerals designate the same parts, even if lower-case letters are added or omitted.

The knife 10 has a housing 11 with a housing part or body 12 and another part or insert 13. The housing insert 13 is movable relative to the housing body 12 between a closed position and an open position. The closed position is shown in FIGS. 1 to 5. The movable housing insert 13 can be locked in the closed position by a latch V. Of the latch V only the actuating button 14 can be seen in FIG. 1.

Moreover, the knife 10 comprises a blade holder 15 carrying a blade 16.

Figure 4:
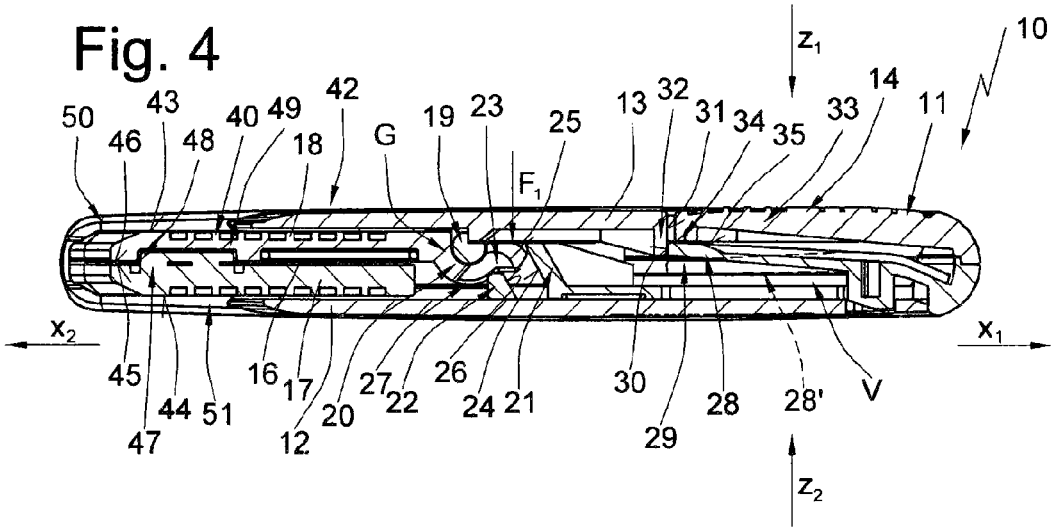
FIG. 4 is a schematic section on line IV-IV of FIG. 3.
Figure 3:
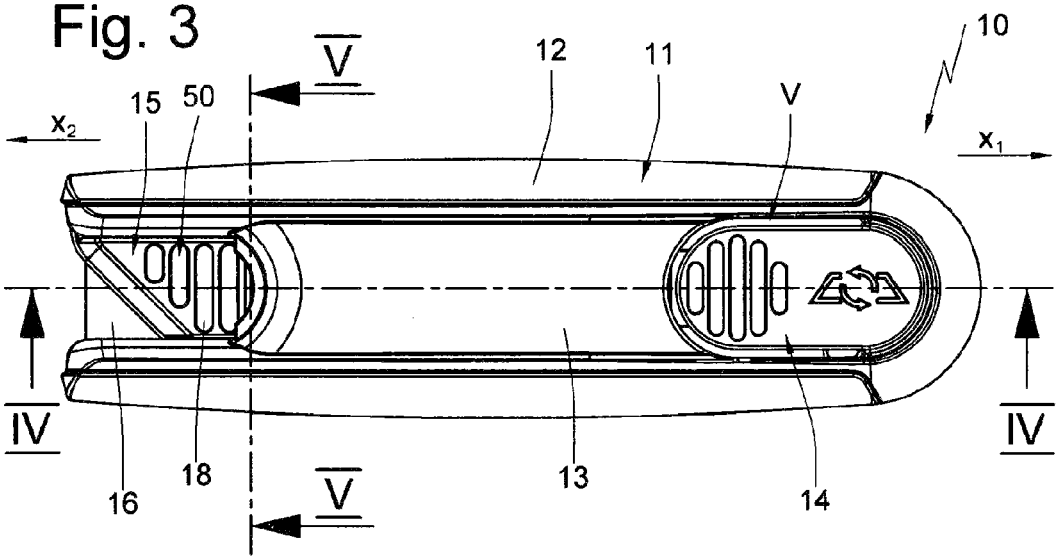
FIG. 3 is a schematic side view of the knife according to FIG. 1.

FIG. 4 shows that the blade holder 15 comprises a main part 17 and a holding part 18. The blade 16 is held in a blade seat between a holding surface 45 of the main part 17 and a holding surface 46 of the holding part 18. For holding the blade 16 by positive engagement, the main part 17 has a projection 47 that passes through a longitudinal hole 48 in the blade 16 and engages in a return 49 of the holding part 18.

The holding part 18 is pivotable about an axis a relative to the main part 17. The axis a is formed by a pivot 19 formed on the main part 17. A bearing structure 20 that partially surrounds the pivot 19 is formed on the holding part 18. The pivot 19 and the bearing structure 20 form a pivot joint G. The holding part 18 is a two-arm lever having a first lever arm 23 and a second lever arm 40.

A first abutment wall 21 as well as a second abutment wall 22 are formed on the housing 11. The abutment walls 21 and 22 cooperate with the first arm 23 of the holding part 18. In particular an abutment surface 24 of the abutment wall 21 cooperates with a surface 25 of the first arm 23 and an outer surface 26 of the abutment wall 22 cooperate with an internal surface of an opening 27 in the first arm 23, as explained in more detail below.

Figure 5:
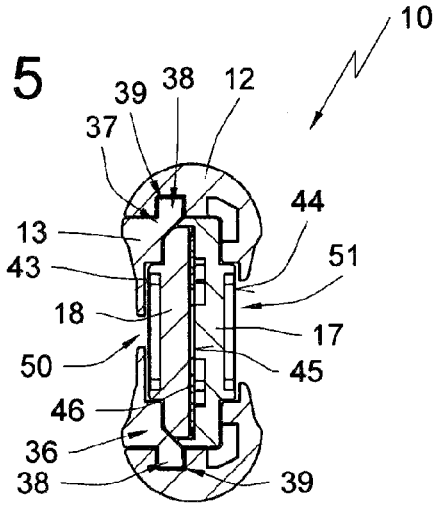
FIG. 5 is a schematic section on line V-V of FIG. 3.
Figure 6:
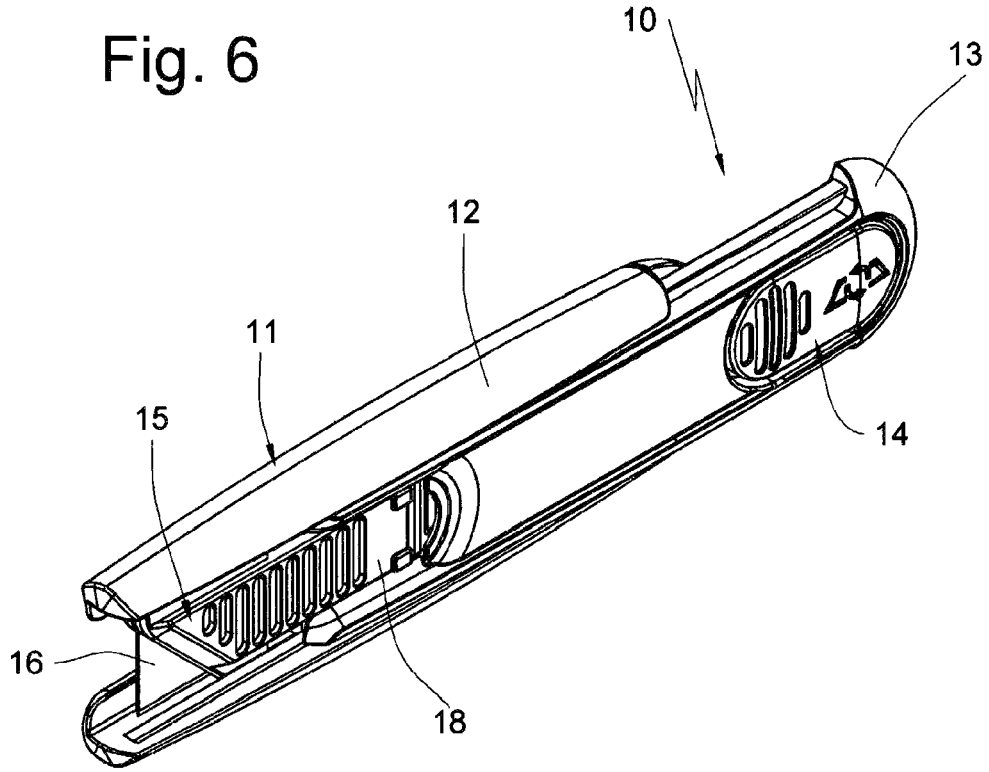
FIG. 6 is a schematic perspective view of the knife where the housing insert is in a position between the closed and the open position.
Figure 7:
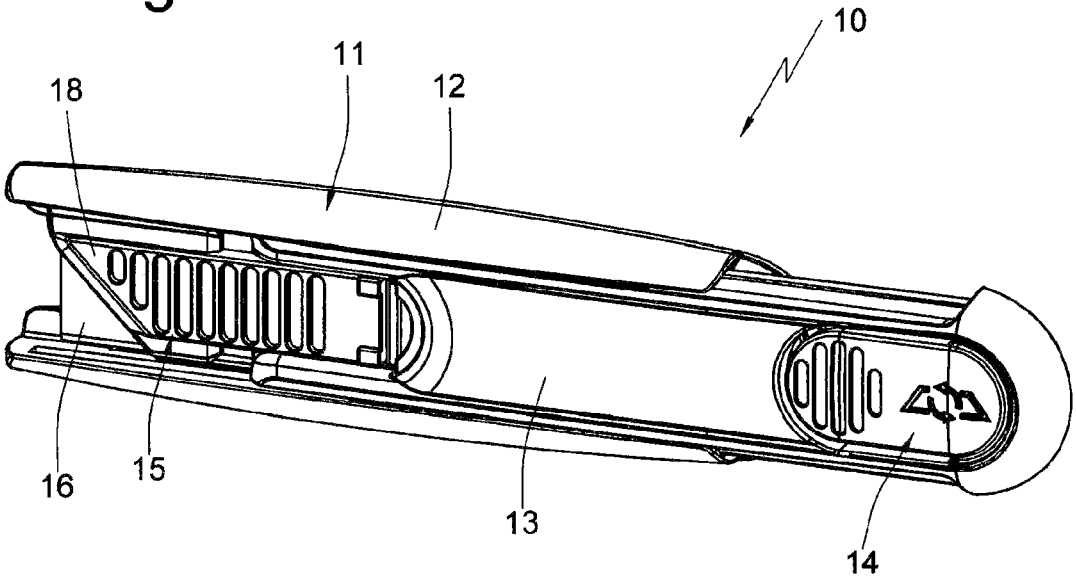
FIG. 7 is a schematic perspective back view of the knife according to FIG. 6.
Figure 9:
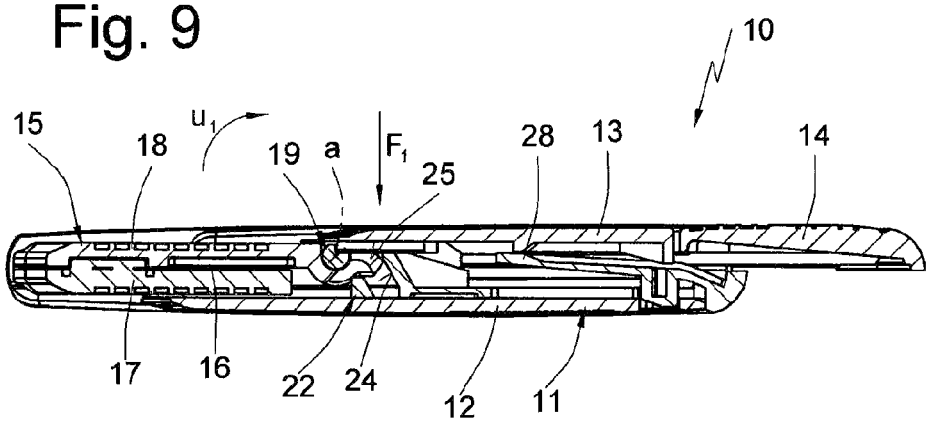
FIG. 9 is a schematic section on line IX-IX of FIG. 8.
Figure 8:
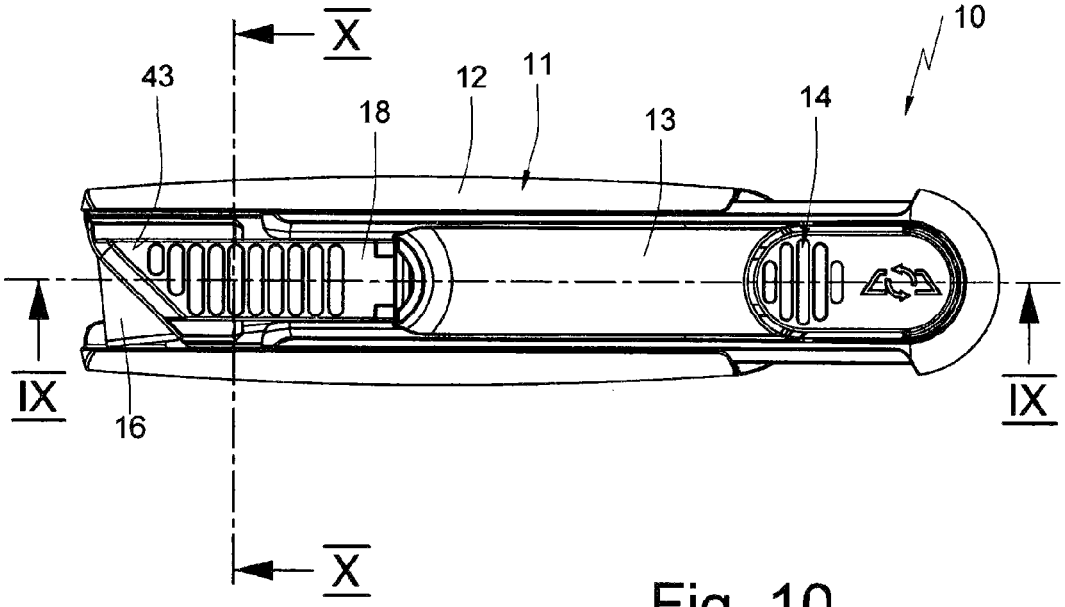
FIG. 8 is a schematic side view of the knife according to FIG. 6.
Figure 10:
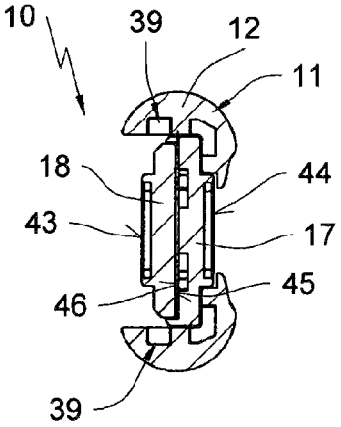
FIG. 10 is a schematic section on line X-X of FIG. 8.

The knife 10 has a guide by which the movable housing insert 13 is guided on the housing body 12. FIG. 5 shows that the movable housing insert 13 is provided on side edges 36 and 37 with guide flanges 38 each slidable in a respective guide groove 39 of the housing body 12. The guide flanges 38 form with the guide grooves 39 a longitudinal guide so that the movable housing insert 13 can slide relative to the housing body 12 in the directions $x_1$ and $x_2$ between the closed position shown in FIG. 1 and the open position shown in FIG. 11.

The latch V has, in addition to the actuating button 14, a resilient locking arm 28 fixed to the housing. The locking arm 28 is provided on an end 29 with a locking surface 30 that cooperates with a stop surface 31. The stop surface 31 is formed on a stop 32 of the movable housing insert 13. In the position shown in FIG. 4 the locking surface 30 is in the travel path of the stop surface 31. For this reason the movable housing insert 13 is not movable in the direction $x_1$ into the open position.

When a free end 33 of the actuating button 14 is moved in the direction $z_1$, an actuating bar 34 formed on the free end 33 presses on an upper outer surface 35 of the end 29 and moves the end 29 in the direction $z_1$ out of the path of the stop surface 31 into the position shown in broken lines in FIG. 4 at 28'. As soon as the locking surface 30 is moved out of the travel path of the stop surface 31, the movable housing insert 13 can be moved out of the closed position shown in FIGS. 1 to 5 in the direction $x_1$ into the open position shown in FIGS. 11 to 16. When the actuating button 14 is no longer actuated, the locking arm 28 springs back in the direction $z_2$ into its starting position.

Figure 16:
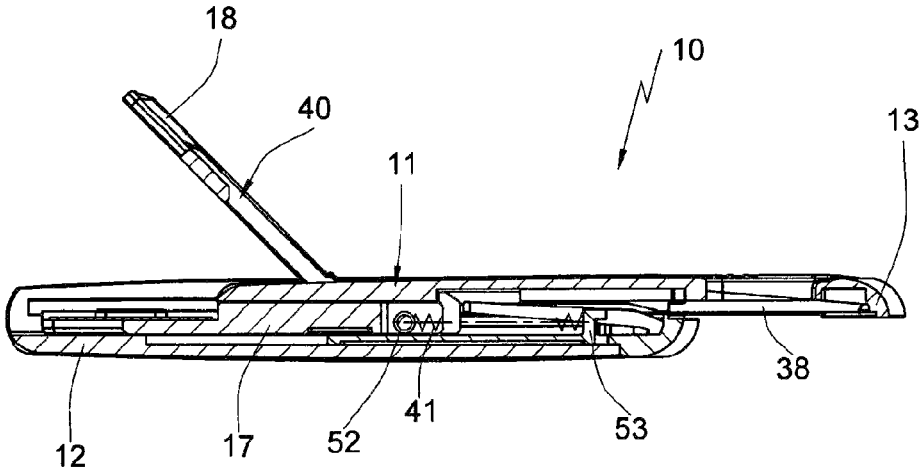
FIG. 16 is a schematic section on line XVI-XVI of FIG. 15.
Figure 15:
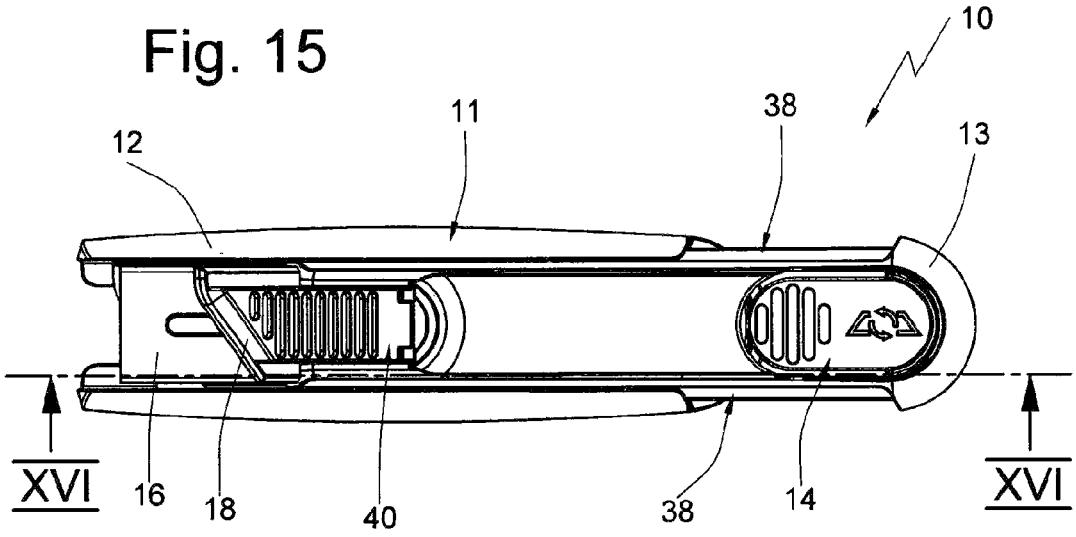
FIG. 15 is a schematic side view of the knife according to FIG. 11.
Figure 17:
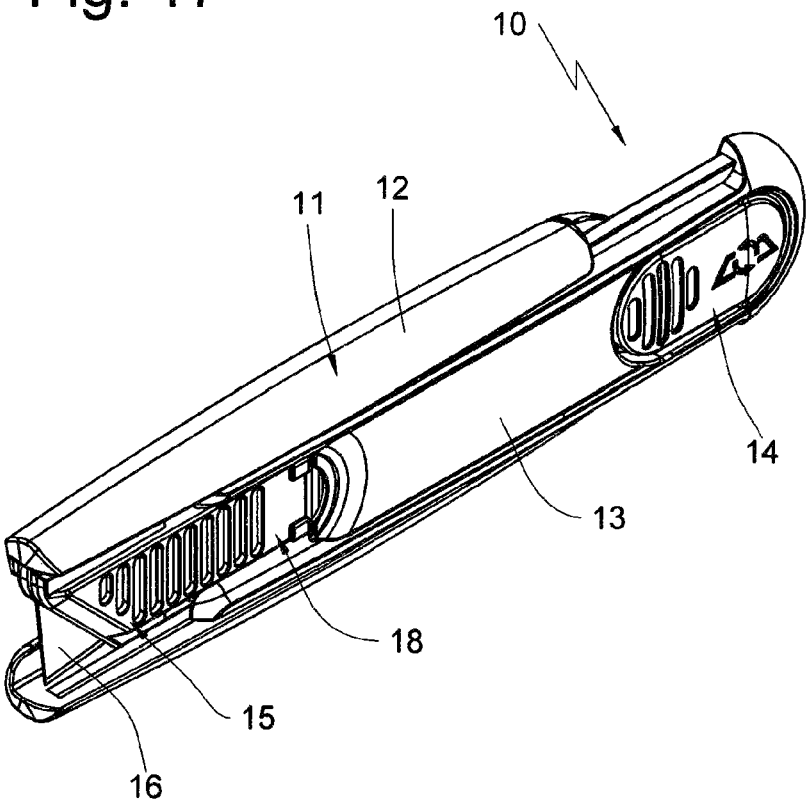
FIG. 17 is a schematic perspective view of the knife where the housing insert is between the open position and the closed position and the holding part is in a position between the replacement position and the holding position.
Figure 18:
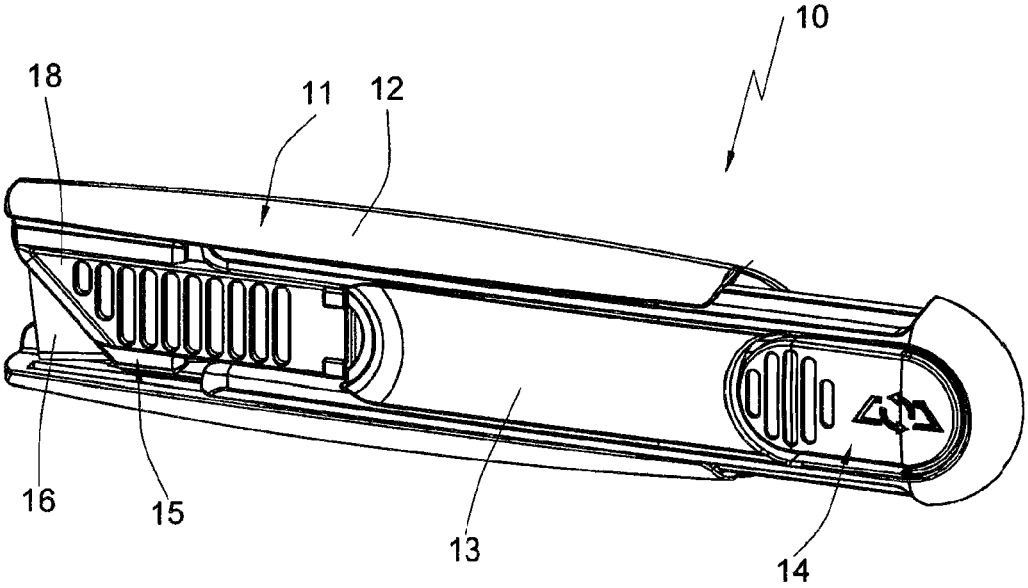
FIG. 18 is a schematic perspective back view of the knife according to FIG. 17.
Figure 20:
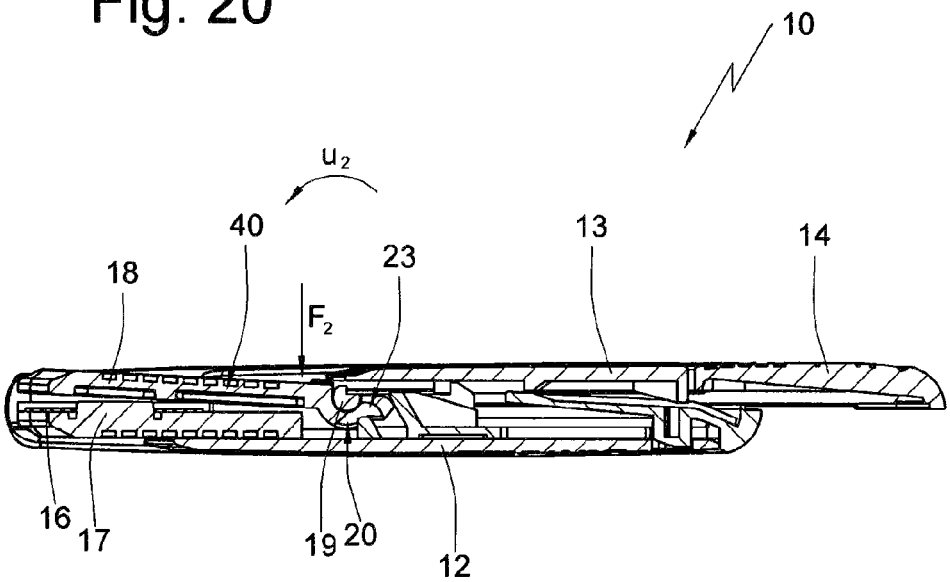
FIG. 20 is a schematic section on line XX-XX of FIG. 19.
Figure 19:
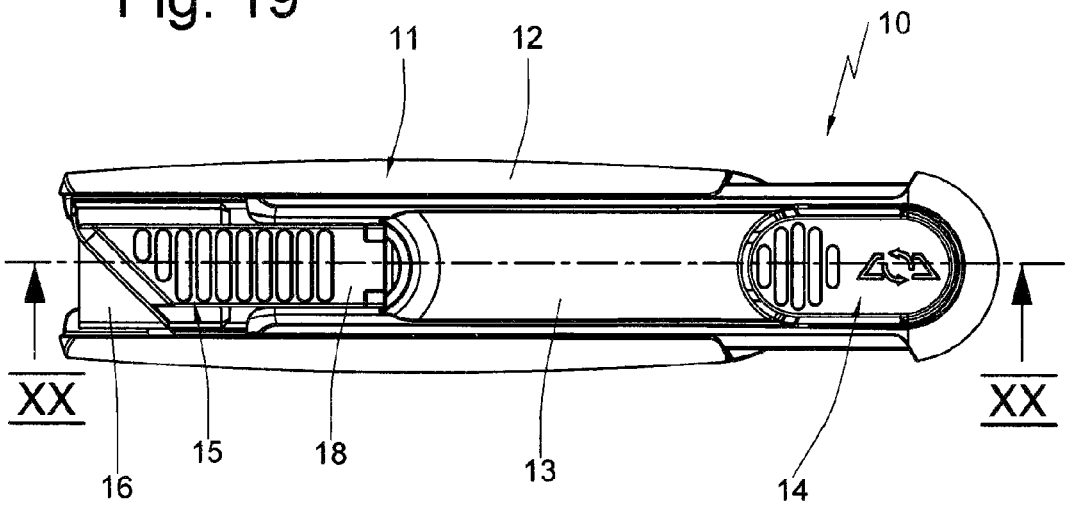
FIG. 19 is a schematic side view of the knife according to FIG. 17.

A spring 41 shown in FIG. 16 is hooked to an anchor formation 52 of the main part 17 and an anchor formation 53 of the housing body 12, and the spring 41 biases the main part 17 in the direction $x_1$ and, in contrast to the view in the drawings presses the surface 25 of the first arm 23 against the abutment surface 24 of the first abutment wall 21. The abutment surface 24 is formed as an inclined surface, i.e. it forms an acute angle to a direction of action of the force of the spring 41. In this way the abutment surface 24 exerts a force $F_2$ in the direction $z_1$ onto the first arm 23, this force creating a torque about the axis a in the direction $u_1$. However, according to FIGS. 1 to 5 the front end 42 of the movable housing insert 13 is in the travel path of the second arm 40 and prevents pivoting of the second arm 40 of the holding part 18 into the position shown in FIGS. 11 to 16.

Even in an intermediate position of the movable housing insert 13 shown in FIGS. 6 to 10 between the closed position and the open position, the holding part 18 cannot pivot in the direction $u_1$ because the front end 42 is in the pivot path of the second arm 40.

As soon as the movable housing insert 13 is moved in the direction $x_1$ so far that the front end 42 is no longer in the travel path of the second arm 40, the holding part 18 can pivot in the direction $u_1$ about the axis a into the replacement position shown in FIGS. 11 to 16. The blade 16 is now accessible and can be removed from the blade seat and replaced by a new blade.

If, in the replacement position of the holding part 18, the blade holder 15 is moved in the direction $x_2$, the internal surface of the opening 27 engages the outer surface 26 of the abutment wall 22. In this way the abutment wall 22 prevents the blade holder 15 from being unintentionally moved in the direction $x_2$ during blade replacement and injuring the user.

Figure 11:
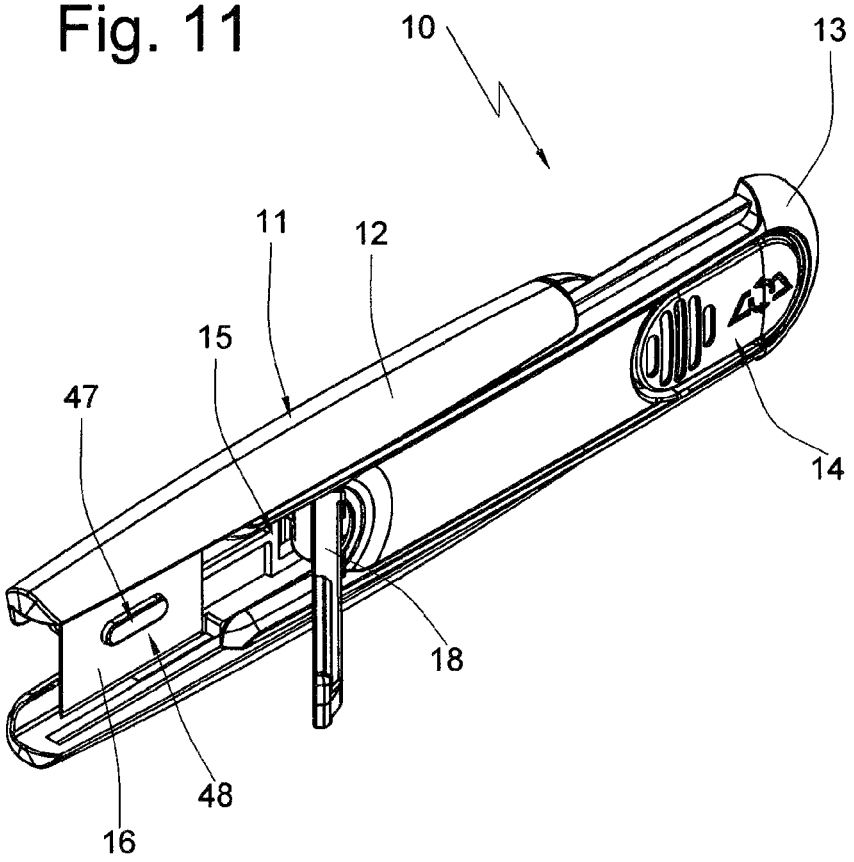
FIG. 11 is a schematic perspective view of the knife where the housing insert is in the open position and the holding part is in the replacement position.
Figure 12:
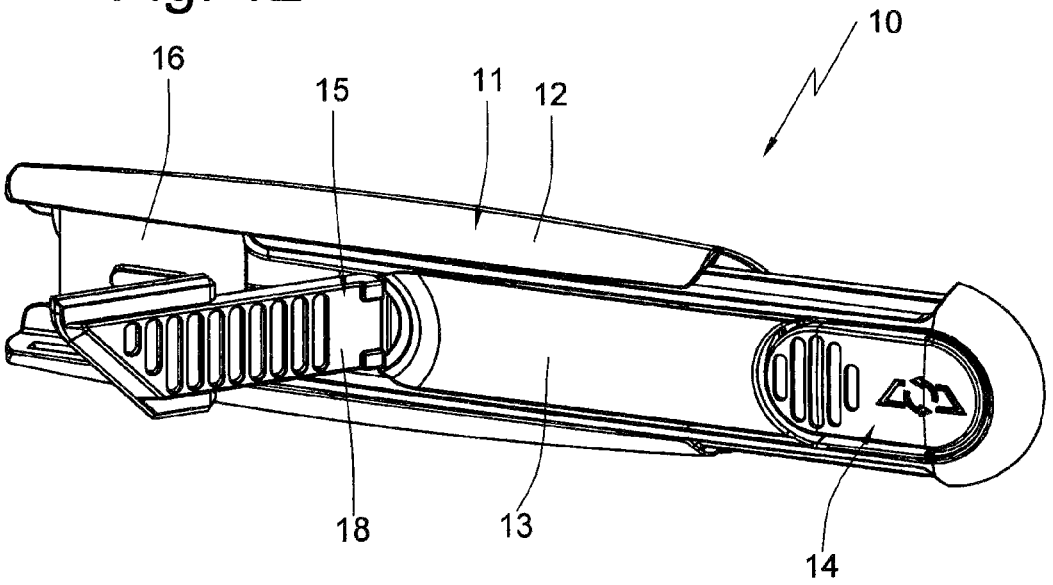
FIG. 12 is a schematic perspective back view of the knife according to FIG. 11.
Figure 14:
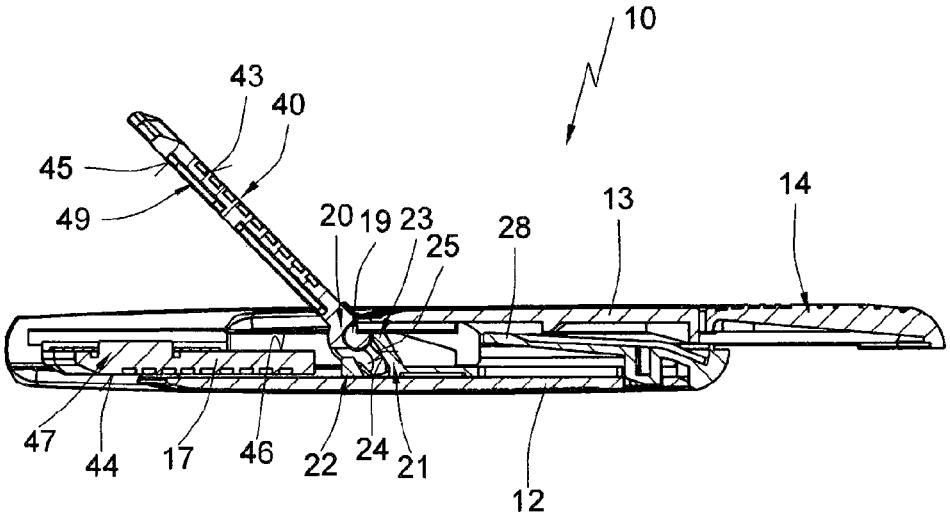
FIG. 14 is a schematic section on line XIV-XIV of FIG. 13.
Figure 13:
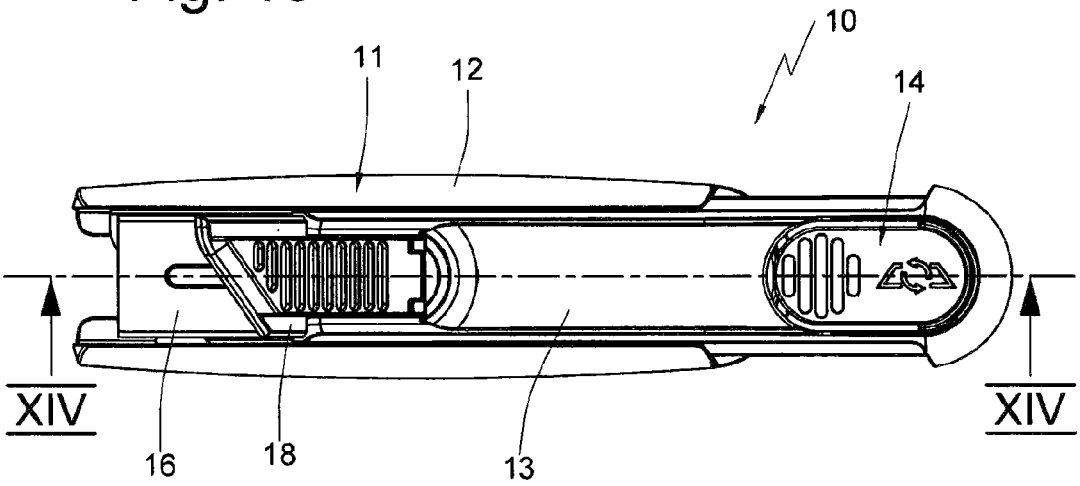
FIG. 13 is a schematic side view of the knife according to FIG. 11.

In order to pivot the holding part 18 out of the replacement position and into the holding position, the movable housing insert 13 is moved out of the position shown in FIG. 11 in the direction $x_2$. A force $F_2$ is exerted on the surface 43 of the lever arm 40 in the direction $z_1$ by the front end 42. The force $F_2$ results in a torque in the direction $u_2$, so that the holding part 18 pivots in the direction $u_2$ (see FIGS. 17 to 20). When the movable housing insert 13 is again in the closed position according to FIGS. 1 to 5, the holding part 18 is pivoted back into its holding position and the lever arm 40 is held in the holding position by the movable housing insert 13.

In order to move the blade holder 15 out of a home position shown in FIGS. 1 to 5, in which the blade 16 is in the housing 11 in such a way that the user cannot be injured, into a cutting position (not shown) in which the blade 16 projects out of the housing 11, the blade holder 15 must be moved in the direction $x_2$. For this purpose the housing 11 has openings 50 and 51 on opposite sides. The blade holder 15 can be gripped and moved in the direction $x_2$ through the openings 50 and 51. A surface 43 of the holding part 18 and a surface 44 of the main part 17 are accessible through the openings 50 and 51. The surfaces 43 and 44 are provided with a structure, so that the blade holder 15 can be gripped without slipping and can be moved in the direction $x_2$.

The invention claimed is:

1. A knife for use with a blade comprising:

a housing body provided with a stop;

a blade holder movably mounted in the housing body and having a main part and a holding part having respective surfaces movable together to define a blade seat adapted to hold the blade, the holding part being pivotal about an axis on the main part between a holding position with the surfaces closely juxtaposed and a blade replacement position with the surfaces spread apart such that in the holding position a blade can be tightly held in a replaceable manner in the blade seat between the surface of the main part and the surface of the holding part, and in the replacement position the blade can be removed from the blade seat or a new blade can be mounted in the blade seat;

an insert having a stop surface and slidable in a longitudinal direction on the housing between a closed position and an open position;

a latch having a stop surface engageable with the stop surface of the insert in the closed position to prevent movement of the holding part into the replacement position, the stop surface of the latch being disengaged to permit such movement; and a spring bearing on and biasing the blade holder relative to the housing body against the stop by a restoring force so as to urge a first lever arm of the blade holder against an abutment surface inclined at an acute angle to the longitudinal direction on the stop and thereby exert a torque on the lever arm urging the blade holder into the replacement position such that the holding part is automatically moved by the torque into the replacement position on movement of the insert into the open position.

2. The knife defined in claim 1, wherein the stop cooperates with the holding part.

3. The knife defined in claim 1, wherein the holding part is a multiarm lever with the first lever arm and at least one second lever arm.

4. The knife defined in claim 3, wherein a mating surface is formed on the first lever arm and the second holding surface is formed on the second lever arm.

5. The knife defined in claim 1, wherein the blade holder is movable between a home position and a cutting position and that at least in the home position the blade holder is biased against the stop.

* * * * *